US006683300B2

(12) United States Patent
Doroshenko et al.

(10) Patent No.: US 6,683,300 B2
(45) Date of Patent: Jan. 27, 2004

(54) METHOD AND APPARATUS FOR MASS SPECTROMETRY ANALYSIS OF COMMON ANALYTE SOLUTIONS

(75) Inventors: Vladimir M. Doroshenko, Ellicott City, MD (US); Victor V. Laiko, Ellicott City, MD (US); Mikhail Yakshin, Ellicott City, MD (US); Coorg R. Prasad, Silver Spring, MD (US); Hyo Sang Lee, Silver Spring, MD (US)

(73) Assignee: Science & Engineering Services, Inc., Burtonsville, MD (US)

( * ) Notice: Subject to any disclaimer, the term of this patent is extended or adjusted under 35 U.S.C. 154(b) by 270 days.

(21) Appl. No.: 09/953,403

(22) Filed: Sep. 17, 2001

(65) Prior Publication Data

US 2003/0052268 A1 Mar. 20, 2003

(51) Int. Cl.[7] ..... H01J 49/16

(52) U.S. Cl. ..... 250/288; 250/282; 250/423 P

(58) Field of Search ..... 250/288, 423 P, 250/282

(56) References Cited

U.S. PATENT DOCUMENTS 4,740,692 A * 4/1988 Yamamoto et al. ..... 250/282
4,977,320 A 12/1990 Chowdhury et al.
5,245,186 A 9/1993 Chait et al.
5,965,884 A 10/1999 Laiko et al.

OTHER PUBLICATIONS

John B. Fenn, et al., Electrospray Ionization for Mass Spectrometry of Large Biomolecules, Science, New Series, vol. 246, Issue 4926 (Oct. 6, 1989), pp. 64–71.

Michael Karas et al., Laser Desorption Ionization of Proteins with Molecular Masses Exceeding 10 000 Daltons, Analytical Chemistry, vol. 60, No. 20, Oct. 15, 1988, pp. 2299–2301.

Victor V. Laiko, et al., Atmospheric Pressure MALDI/Ion Trap Mass Spectrometry, Analytical Chemistry, vol. 72, No. 21, Nov. 1, 2000, pp. 5239–5243.

Victor V. Laiko, et al., Atmospheric Pressure Matrix–Assisted Laser Desorption/Ionization Mass Spectrometry, Analytical Chemistry, vol. 72, No. 4, Feb. 15, 2000, pp. 652–657.

Frank Sobott et al., Laser Desorption Mass Spectrometry on Thin Liquid Jets, Fresenius J Anal Chem (1998) 360: pp. 745–749.

Steven J. Lawson and Kermit K. Murray, Continuous Flow Infrared Matrix–Assisted Laser Desorption/Ionization with A Solvent Matrix, Rapid Communications In Mass Spectrometry, Rapid Commun. Mass Spectrom 14, pp. 129–134 (2000).

(List continued on next page.)

*Primary Examiner*—Jack Berman
(74) *Attorney, Agent, or Firm*—Oblon, Spivak, McClelland, Maier & Neustadt, P.C.

(57) ABSTRACT

A method, system, and apparatus for mass spectroscopic analysis of an analyte solution in which a liquid volume of the analyte solution is irradiated with a light source resulting in desorption of solution-specific ions into a surrounding gas to produce gas-phase ions, the gas-phase ions are transferred to an inlet port of a mass analyzer, and the gas-phase ions are mass analyzed. More specifically, the apparatus may include a laser configured to pulse irradiate a surface of the analyte solution, a mass spectrometer configured to mass-analyze the gas-phase ions according to the mass-to-charge ratio, and a transfer mechanism configured to transfer the gas-phase ions to an inlet port of the mass spectrometer.

85 Claims, 6 Drawing Sheets

OTHER PUBLICATIONS

Ichiro Kudaka et al., A Comparative Study of Laser Spray and Electrospray, Rapid Communications In Mass Spectrometry, Rapid Commun. Mass Spectrom. 14, pp. 1558–1562 (2000).

Kenzo Hiraoka et al., A New Liquid Chromatography/Mass Spectrometry Interface: Laser Spray, Rapid Communications In Mass Spectrometry, Rapid Commun. Mass Spectrom. 12, pp. 1170–1174 (1998).

Baiwei Lin and Jan Sunner, Ion Transport by Viscous Gas Flow Through Capillaries, Department of Chemistry, Montana State Univ., Bozeman, Montana, USA, J Am Soc Mass Spectrom 1994, 5, pp. 873–885.

Gerhard Schomburg, Coated Capillaries in High–Performance Capillary Electrophoresis, Chemical Analysis, 1998 vol. 146, pp. 481–523.

B.F. Chmelka and A. Pines, Some Developments in Nuclear Magnetic Resonance of Solids, Oct. 6, 1989, pp.

A.P. Bruins, Mass Spectrometry With Ion Sources Operating At Atmospheric Pressure, Mass Spectrometry Reviews 1991, 10, pp. 53–77.

Masamichi Yamashita and John B. Fenn, Electrospray Ion Source. Another Variation on the Free–Jet Theme, J. Phys. Chem. 1984, 88, pp. 4451–4459.

E.C. Horning et al., New Picogram Detection System Based on a Mass Spectrometer with an External Ionization Source at Atmospheric Pressure, Analytical Chemistry, vol. 45, No. 6, May 1973, pp. 936–943.

Craig M. Whitehouse et al., Electrospray Interface for Liquid Chromatagraphs and Mass Spectrometers, Anal. Chem., vol. 57, No. 3, Mar. 1985, pp. 675–679.

* cited by examiner

METHOD AND APPARATUS FOR MASS SPECTROMETRY ANALYSIS OF COMMON ANALYTE SOLUTIONS

BACKGROUND OF THE INVENTION

1. Field of the Invention

The present invention relates to mass spectrometry and more specifically to an ionization technique to produce ions in a surrounding gas.

2. Discussion of the Background

In nature and in the laboratory, compounds of biological and biochemical material are frequently present in a liquid form, usually water-based referred to as analyte solutions. In cells of living organisms, protein and DNA molecules are diluted in water which may contain in small quantities other organic and inorganic additives necessary for maintaining electrical and chemical properties required for normal cell functionality and intercellular interaction. Any changes in chemical composition of cell solution can result in corruption of cell processes or even its death. Monitoring of cell processes can also interfere with cell normal operation resulting in some cases in wrong observations and conclusions.

Mass spectrometry is a common method used for detection and identification of separated products. Mass spectroscopy is an informative and powerful method for analyte analysis. Unfortunately, buffer solutions used in separation methods and buffer solutions used in mass spectrometry are not usually compatible with each other. As a result only a limited number of buffer solutions can be used commonly between separation and mass analysis techniques. In matrix assisted laser desorption ionization (MALDI), one of methods used for bioanalyte molecule ionization, special treatments of the sample are required which may include purifying the analyte solution to remove buffer salts, mixing the analyte solution with a matrix solution, depositing and drying the combined mixture on a surface (to be laser irradiated). As a result, MALDI analysis is usually made in an off-line mode and requires special equipment for treatment and handling of samples.

Interfacing of the analyte solutions to the mass spectrometers occurs in the ion sources of the mass spectrometers. More than twenty different types of ion sources are known to date. Of these ion sources, atmospheric pressure (AP) ion sources are playing an increasingly important role for modern analytical applications of mass spectrometry. AP chemical ionization (CI) sources produce ions of volatile analytes with molecular masses within the mass range of 1–150 Da (i.e., atomic mass units). See e.g., the review of Bruins, A. P., in Mass Spectrom. Rev. 1991, vol. 10, pp. 53 and following; the entire contents of which are incorporated herein by reference. Electrospray Ionization (ESI), widely used in modern analytical equipment, can transfer heavy intact molecular ions (with masses of several hundred thousand Dalton) from a liquid analyte solution to a gas phase for subsequent mass analysis. biochemistry See e.g., Yamashita, M., Fenn, J. B. J.Chem.Phys. 1984, vol. 88, pp. 4451–4459 and Fenn, J. B.; Mann, M.; Meng, C. K.; Wong, S. F.; Whitehouse, C. M. Science 1989, vol. 246, pp. 64–71; the entire contents of which are incorporated herein by reference. Meanwhile, AP MALDI sources produce ions of heavy biomolecules under normal atmospheric pressure conditions wherein laser irradiation typically interacts with analyte/matrix solid microcrystals. See e.g., U.S. Pat. No. 5,965,884; the entire contents of which are incorporated herein by reference.

Atmospheric pressure ion sources have several important advantages over "internal" vacuum ion sources.

First, sample ionization takes place in an atmospheric pressure ion source outside the MS instrument itself. Consequently, AP ion sources are interchangeable, and one MS instrument can be adopted to a number of AP sources. Second, gas/liquid/solid sample delivery (or loading) takes place under normal laboratory atmospheric pressure. Third, due to high pressures employed with AP sources, ions produced inside the AP ion source by chemical ionization (CI), electrospray ionization (ESI), or AP MALDI, for example, achieve thermal equilibrium with ambient gas extremely fast. Fast "cooling" of the produced ions favors the production of intact molecular ions rather than non-specific fragmented ions.

Ions produced under atmospheric pressure by an AP ion source are introduced into the vacuum chamber of a mass spectrometer through a special device that is known as an atmospheric pressure interface (API). Typically, an API includes several stages of differential pumping separated by several gas apertures. The pressure on the exterior of the API is at or around atmospheric pressure and can be adjusted by pressurizing or depressurizing the exterior region of the API. Gas from the exterior region is conducted by vacuum into the API, i.e., a conductive limit limiting the amount of gas which can be admitted into the mass spectrometer.

There are two main designs for an inlet gas aperture of an API. One design includes a pinhole orifice in a thin membrane-type flange that separates the atmospheric pressure region and the first vacuum chamber of the MS instrument with the typical pressure of 0.1–5 mTorr. See e.g., the design introduced by Horning et. al., in Anal. Chem. 1973, vol. 455, pp. 936–943; the entire contents of which are incorporated herein by reference. In a second design, the atmospheric pressure region is connected with the intermediate vacuum chamber (i.e., 0.1–5.0 mTorr) through a transport capillary with a typical inner diameter of 0.1–1 mm. See e.g., the design developed by Whitehouse et al. in Anal. Chem. 1985, vol. 57, pp. 675–679; the entire contents of which are incorporated herein by reference. In a third design, a heated capillary delivers atmospheric pressure ions into a vacuum chamber. See e.g., U.S. Pat. Nos. 4,977,320 and 5,245,186; the entire contents of which are incorporated herein by reference. Usually, the transport capillary is heated to a temperature of 80-250° C. for ion desolvation. The heated transport capillary has several advantages over the aforementioned pinhole interface and is used in modern commercial and scientific MS instruments. The process of ion transport by viscous gas flow through capillaries is detailed by B. Lin and J. Sunner in J. Am. Soc. Mass Spectrom. 1994, vol. 5, pp. 873–885; the entire contents of which are incorporated herein by reference.

In one atmospheric pressure ionization technique, electrospray ionization takes place under normal atmospheric pressure conditions. See e.g. Yamashita, M.; Fenn, J. B. J. Chem. Phys. 1984, vol. 88, pp. 4451–4159 and Fenn, J. B.; Mann, M.; Meng, C. K.; Wong, S. F.; Whitehouse, C. M. Science 1989, vol. 246, pp. 64–71; the entire contents of which are incorporated herein by reference. For electrospray ionization, a slightly electroconductive liquid analyte solution is pumped through a thin metal or insulator tube. A high voltage of several hundred volts is applied between the liquid and the counterelectrode. As a result, a Taylor cone is formed at the exit orifice of the capillary tube. The liquid surface at the tip of that cone loses stability, and a cloud of very fine liquid droplets forms. These droplets are electrically charged. After drying, a cloud of molecular analyte ions is formed in an atmospheric pressure region of the exit orifice.

For mass analysis of atmospheric pressure produced ions, mass spectrometers sample through an entrance orifice (i.e. the API) ambient gas along with the atmospheric pressure produced ions and transfer the ions into the high vacuum chamber of a mass analyzer.

By contrast, in vacuum Matrix Assisted Laser Desorption Ionization, laser desorption and ionization takes place inside a vacuum chamber under vacuum conditions. See e.g., Karas, M; Hillenkamp, F.; Anal. Chem. 1988, vol. 60, pp. 2299–2301; the entire contents of which are incorporated herein by reference. A target is prepared by mixing a solution of analyte molecules with a specially chosen material known as a matrix, usually an organic acid in the form of solid crystals. The solution is then dried on a target plate to form a solid analyte and matrix material. The target plate is irradiated in vacuum with a UV or IR laser pulses. The matrix material absorbs the radiation, and a plume of hot matrix molecules lifts the analyte molecules into the gas phase.

In AP MALDI, an analyte sample, such as the aforementioned solid analyte and matrix resides outside the vacuum system, and irradiation of the matrix material creates hot plume similar to vacuum MALDI with the analyte molecules liberated into a region near an API. The AP MALDI ion source is interchangeable with electrospray ionization sources. See e.g., U.S. Pat. No. 5,965,884; the entire contents of which are incorporated herein by reference. The same mass spectrometer instrument can be used for both Electrospray and AP MALDI measurements. AP MALDI is a softer ionization technique as compared to vacuum MALDI. Ions produced by AP MALDI under atmospheric pressure conditions are quickly cooled by the ambient gas before thermal fragmentation can take place. See e.g., Victor V. Laiko, Michael A. Baldwin, Alma L. Burlingame, "Atmospheric Pressure Matrix-Assisted Laser Desorption/Ionization Mass Spectrometry", Analytical Chemistry, Vol. 72, No.4, Feb. 15, 2000, pp. 652–657; Victor V. Laiko, Susanne C. Moyer, Robert J. Cotter, "Atmospheric Pressure MALDI/Ion Trap Mass Spectrometry", Analytical Chemistry, vol. 72, No. 21, 2000, pp. 5239–5243; the entire contents of which are incorporated herein by reference.

In another atmospheric pressure ionization technique, Laser-Assisted Electrospray, source heating of a surface layer of a Taylor cone is provided with a continuous $CO_2$ laser (10.6 $\mu$m wavelength) to overcome some limitations of the Electrospray technique and to increase ion production and permit a high liquid flow rate. See e.g., Hiraoka, K.; Saito, S.; Katsuragawa, J.; Kudaka, I. Rapid Comm. Mass Spectrom. 1998, vol. 12, pp. 1170–1179 and Kudaka, I.; Kojima, T.; Saito, S.; Hiraoka, K. Rapid Comm. Mass Spectrom. 2000, vol. 14, pp. 1558–15562; the entire contents of which are incorporated herein by reference.

In another vacuum ionization technique, Continuous Flow Liquid MALDI (CF-MALDI) provides an on-line interface of a liquid separation technique such as for example High Performance Liquid Chromatography (HPLC) and Capillary Zone Electrophoresis (CZE) to a vacuum MALDI instrument. See e.g., Lawson, S. J.; Murray, K. Rapid Comm. Mass Spectrom. 2000, vol. 14, pp. 129–134; the entire contents of which are incorporated herein by reference. A flow of a liquid analyte/matrix solution is pumped into the vacuum chamber through a thin capillary tube. At the exit of the capillary tube inside the vacuum chamber, vapors from the analyte/matrix solution are irradiated with laser pulses to induce MALDI. An efficient pumping system prevents too large a pressure increase inside the vacuum chamber as a result of the fast liquid evaporation/boiling in the vacuum.

Laser Induced Liquid Beam Ionization Desorption (LILBID) is another vacuum ionization technique similar to CF-MALDI. See Sobott, F.; Wattenberg, A.; Kleinekofort, W.; Pfenninger, A.; Brutschy, B., Fresenius' J. Anal. Chem. 1998, v. 360, p. 745–749; the entire contents of which are incorporated herein by reference. Here again, a liquid flow including the matrix component is introduced into a vacuum chamber through a capillary. At the exit of the capillary, a nozzle is used to produce a jet of a vaporized liquid analyte/matrix solution inside the vacuum chamber. A focused laser beam intersects the jet trajectory, inducing MALDI. Excess vapor from the liquid is absorbed and frozen onto a liquid nitrogen-cooled trap. An efficient pumping system maintains the vacuum inside the mass spectrometer.

Thus, prior to the present invention, mass analysis involved chemical or physical alteration of the analyte solution prior to ionization resulting in corruption of the analyte solution. Such corruption can change the chemical, physical, and biological properties of the analyte solution, and in the case of the various MALDI techniques, at a minimum, contaminated the solutions with acidic matrix materials, making mass analysis more convoluted and subsequent analysis of the analyte solution by other techniques difficult, if not impossible.

SUMMARY OF THE INVENTION

One object of the present invention is to provide a precise analytical method for conducting cellular experiments without corrupting the cell functions.

One object of the present invention is to mass analyze common analyte solutions, thus removing most of the treatment steps required for MALDI-based mass spectroscopy.

Another object of the present invention is to mass analyze analyte solutions compatible with subsequent analysis of the analyte solutions by other analytical techniques. For example, nuclear magnetic resonance NMR could complement mass analysis of analyte solutions that had been uncompromised by chemical derivation of secondary protein structures.

One object of the present invention is to ionize analyte biomolecules at or near atmospheric pressure conditions directly from common, natural aqueous solutions using laser irradiation.

Another object of the present invention is to transfer gas-phase ionized species produced from the common aqueous solutions into a mass analyzer.

Still another object of the present invention is to mass-analyze the gas-phase ionized species produced from the common aqueous solutions.

These and other objects are achieved by providing a novel method and system and apparatus for mass spectroscopic analysis of an analyte solution. The method and system include the steps of or means for irradiating a liquid volume of the analyte solution with a light beam resulting in desorption of solution-specific ions into a surrounding gas to produce gas-phase ions, transferring the gas-phase ions to a mass, and mass-analyzing the gas-phase according to a mass to charge ratio. The apparatus can include a light source configured to irradiate the volume of the analyte solution, a mass spectrometer configured to mass-analyze the gas-phase ions, and a transfer mechanism configured to transfer the gas-phase ions to an inlet port of the mass analyzer.

According to the present invention, Laser Assisted Desorption Ionization (LADI) provides an ionization technique by which solutions including aqueous solutions of biopolymer molecules can be ionized at ambient pressures to produce the gas-phase ions upon which mass analysis occurs. Ambient pressure ionization is achieved by irradiating the aqueous solutions with a pulsed laser at an absorption wavelength of the solution. An atmospheric pressure interface API is used to introduce the gas-phase ions into a mass analyzer. In a preferred embodiment, an IR laser having a wavelength near 3 $\mu$m is strongly absorbed by aqueous and other natural solvents so that gas-phase ions are generated from the liquid solutions. Matrix molecules normally used to assist in the ionization process are not required.

In accordance with the present invention, ions are produced at or about atmospheric pressure directly from an analyte solution which is deposited as a droplet or thin layer atop of a solid target plate. The analyte solution is irradiated with an intense light source, preferably a pulsed infrared laser at an absorption wavelength of the analyte solution. Analyte molecular ions are produced near the surface of the solution. The ions are directed toward the API inlet of the mass spectrometer by an air/gas flow and/or an electric field configured to collect ions into the API. The present invention is not limited to a particular atmospheric pressure intake, and various atmospheric pressure interfaces can be used for delivery of produced ions from the atmospheric conditions into the mass spectrometer.

In one aspect of the present invention, the light source includes a laser beam and more particularly a pulsed laser beam. In another aspect, the gas-phase ions can be produced at or about atmospheric pressures, and the transfer mechanism includes an inlet port on a mass spectrometer equipped with an atmospheric pressure interface.

In one aspect of the present invention, the analyte solution is deposited on a substrate. The analyte solution can be deposited in the form of a droplet or a thin layer. The volume of the droplet is preferably less than 2 $\mu$l. The substrate can include a gold surface or a stainless steel surface. The substrate can include at least one well, or a substrate including at least one groove. The gold surface can include a 10–15 $\mu$m nickel layer deposited underneath a 10–15 $\mu$m gold layer. The substrate can include a frit or a gel. The gel can be taken from a biopolymer separation using a two-dimensional gel electrophoresis method. The substrate can be curved to flatten the surface of the analyte solution.

In one aspect of the present invention, an optical fiber delivers laser pulses to the analyte solution. The light beam can irradiate the analyte solution with laser pulses at a wavelength which is strongly absorbed by the analyte solution. If the analyte solution includes water as a primary solvent, the analyte solution can be irradiated by infrared laser pulses at a wavelength close to 3 $\mu$m.

In one aspect of the present invention, the mass analyzer includes an inlet orifice attached to an inlet port of a mass spectrometer or a capillary tube attached to the inlet port of a mass spectrometer. The transfer mechanism can include an electric field between the analyte solution and the inlet port of the mass spectrometer or the capillary tube attached to the inlet port to assist in transfer of said gas-phase ions to the mass analyzer. The present invention can include at least one gas nozzle to produce a gas flow to transfer the gas-phase ions toward the inlet port of the mass spectrometer or the capillary tube attached to the inlet port.

In one aspect of the present invention, a supply mechanism can supply the analyte solution to a target surface of the light beam. The supply mechanism can include a capillary transfer line delivering the analyte solution to the substrate.

The analyte solution can include water, organic fluids, inorganic fluids, or a mixture thereof. The analyte solution can include solutions of organic and inorganic compounds including at least one of peptides, proteins, nucleic acids, polymers, drugs, and other compounds of biological, medical or industrial significance.

In one aspect of the present invention, a motion mechanism moves the substrate with respect to the inlet port of the mass spectrometer, and a supply mechanism can supply the analyte solution to the substrate to maintain a thin liquid layer to thereby increase ionization efficiency. In another aspect of the present invention, a motion mechanism moves the substrate with respect to the capillary transfer tube, and a supply mechanism can supply the analyte solution to the substrate to maintain a thin liquid layer to thereby increase ionization efficiency. The supply mechanism can include a frit at an exit end of the supply mechanism to interface the liquid flow of the analyte solution with light pulses from the light beam. A sensor can regulate a balance of the analyte solution, and a regulation mechanism can regulate the balance by adjusting a liquid flow rate, a light beam pulse energy, and/or a pulse repetition rate. A liquid separation apparatus can provide a continuous flow of the analyte solution to the mass analyzer to thereby provide on-line coupling to the mass analyzer. The liquid separation apparatus can include a high-performance liquid chromatograph or a capillary zone electrophoresis unit. A flow splitter can direct a part of an effluent solution from the liquid separation apparatus into the mass analyzer.

In one aspect of the present invention, a housing encompassing the transfer mechanism can be filled with a gas under defined pressure and temperature conditions.

According to the present invention, ionization can take place at or about atmospheric pressure and not in a vacuum as in CF-MALDI or LILBID. "At or about" indicates a range of suitable pressures existing on an exterior of the API, preferably between 0.1 and 1000 Torr. The range being dependent on gas conduction properties through the API which change abruptly from laminar flow to molecular flow at pressures below 0.1 Torr. Unlike AP-MALDI, in the present invention, a special matrix is not required to be added to the sample for MS analysis, as required in AP-MALDI. The electric field in the vicinity of the sample surface in the present invention is preferably not as strong as the electric field utilized in electrospray ionization. Consequently, droplet formation in the gas phase (including a Taylor cone) is not prevalent in the present invention. In the present invention, gas-phase ions are formed by desorbing ions into the gas phase rather than by generating droplets with subsequent evaporation into ionized solvent molecules. Gas-phase ions of the present invention are formed mostly in a singly-charged state. In contrast, electrospray ions are typically multiply-charged. Gas-phase ions in the present invention can be formed using a pulsed laser which generates ions via fast non-equilibrium processes occurring during desorption and transfers ions from the liquid to the gas phase.

BRIEF DESCRIPTION OF THE DRAWINGS

Other objectives and features of the present invention will be apparent from the following detailed description of the invention seen in conjunction with the accompanying drawings.

DETAILED DESCRIPTION OF THE PREFERRED EMBODIMENTS

There is a need for developing precision analytical methods by which one can conduct cellular experiments that do not corrupt or interfere with the cell functions. After the extraction of cellular biochemical analyte compounds, separation is usually the next step in the study of the extracts. During the separation process, biochemical analytes can be dissolved in buffer solutions to produce the common analyte solutions of the present invention. The buffers utilized are specific to the separation technique used (e.g., high-performance liquid chromatography separation HPLC, capillary zone electrophoresis—CZE, gel electrophoresis, etc.). These buffers are normally water-based with addition of organic or inorganic solvents or salts. The purpose of using such additives is to maintain or improve the chemical and electrical properties of the analyte solution, electromigration of analytes, etc. See Schomburg, G. in High-Performance Capillary Electrophoresis Theory, Techniques, and Applications, Ed. M. G. Khaledi, Wiley, N. Y., 1998, p. 481–523; the entire contents of which are herein incorporated by reference. Examples of such additives are: Tris [tris(hydroxymethyl)aminomethane], ethylenediamine, phosphates, acetonitrile, methanol, ethanol, dithiothreitol, $CaCl_2$, NaOH, KCl, $MgCl_2$, formic acid, acetic acid, TFA (trifluoroacetic acid) etc. The buffer type is dictated by the separation technique used. The above analalyte solutions are examples of matrix-free analyte solutions.

Figure 1:
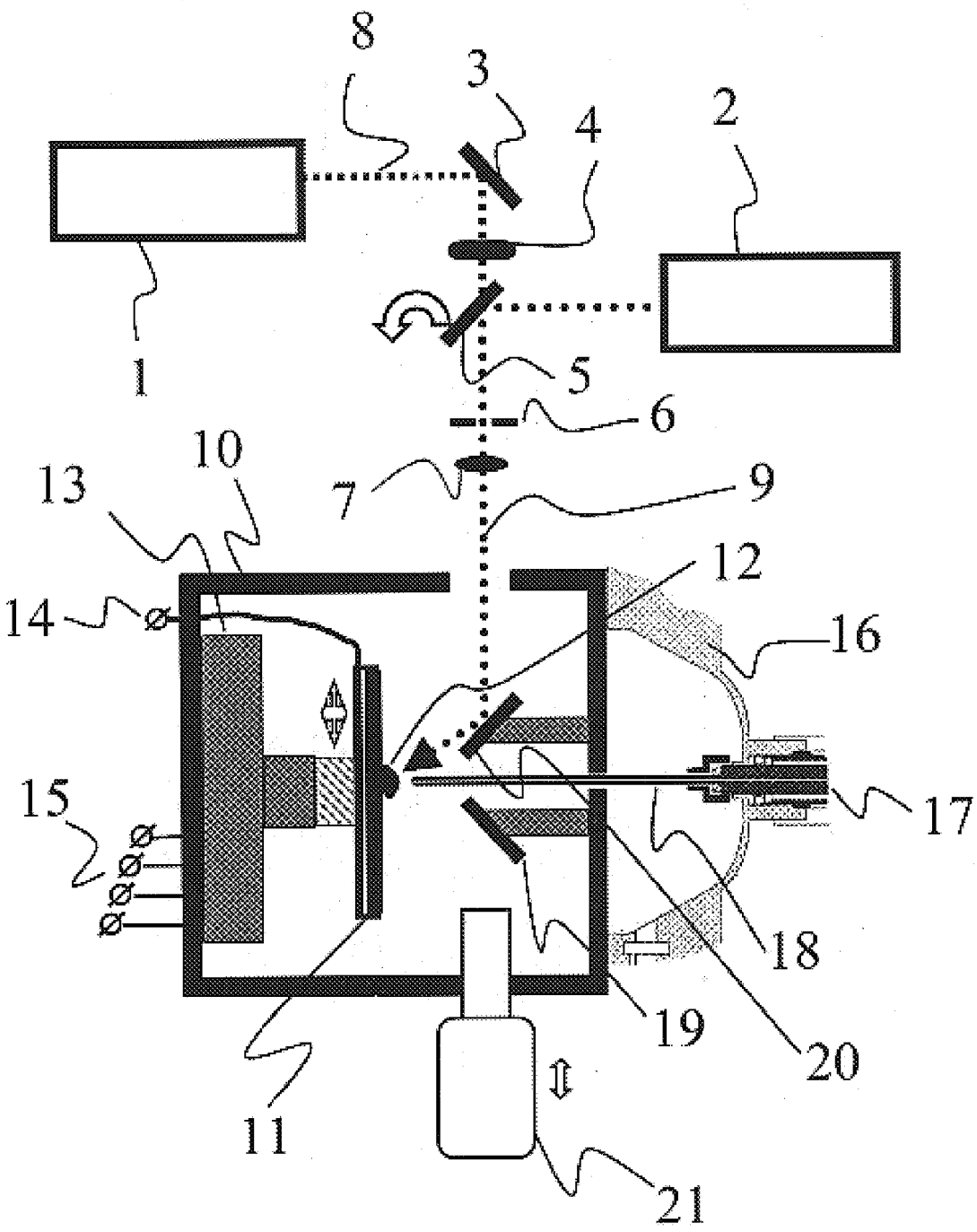
FIG. 1 is a schematic view of one embodiment of the present invention showing an AP-LADI interfaced to an ion trap mass spectrometer.

A more complete appreciation of the invention and many of the attendant advantages thereof will be readily obtained as the same becomes better understood by reference to the following detailed description when considered in connection with the accompanying drawings, wherein FIG. 1 represents a basic configuration, according to the present invention in which an external AP-LADI source is interfaced to a mass spectrometry. The mass spectrometer can be for example a LCQ ion trap mass spectrometer manufactured by Thermo Finnigan (San Jose, Calif.).

A droplet of a sample solution 12 is deposited on a target plate 11 of AP-LADI source of the present invention. Both the size (thickness) of the droplet and the material of the target plate surface can influence the ion source operation, as to be more fully discussed.

In a preferred embodiment, aqueous droplets of a microvolume of 0.5–5.0 $\mu$l are deposited on a steel target plate coated with nickel and gold layers (the coatings of Ni and Au are each 10–15 $\mu$m thick). The amount of volume to be deposited is dependent on the ability of the droplet to held on a vertical surface. The liquid droplet of the sample solution 12 is irradiated with an IR laser 2 having for example a beam 9 of about 3 $\mu$m in wavelength. The 3 $\mu$m wavelength is preferable because of a strong absorption of water at this wavelength.

The laser beam 9 is focused with a calcium fluoride lens 7 and a turning mirror 20. For comparison purposes, the IR laser beam 9 can be switched to a UV beam 8 having for example a 337 nm wavelength using a flipping mirror 5. In one embodiment, a Yb:YAG-pumped optical parametric oscillator OPO laser system tunable in the wavelength range of 1.5–4 $\mu$m is used as the IR source 2 and a nitrogen laser is used as a source of the UV light 1. The light source for irradiation can be any suitable laser or high intensity pulsed light source of sufficient power density and of requisite wavelength to create desorption and ionization of the target analyte solutions, such as for example those light sources disclosed herein. Such light sources can further include but are not limited to Er:YAG lasers, flashlamps, controlled chemical explosions, etc. Further, the wavelength of the light irradiation is chosen according to the analyte solution used. For example, a analyte solution including water for example would preferably be irradiated by a wavelength of about 3 $\mu$m. In general, a higher absorption of a particular wavelength benefits ion formation by presenting a lower energy threshold for ion formation.

FIG. 1 illustrates that the size of the target plate 11 does not allow the AP LALDI source to be placed in close proximity to an inlet orifice of the heated capillary 17, attached to an inlet flange 16 of LCQ. According to the present invention, the heated capillary 17 is extended with an additional capillary 18 (ID 0.3–1.0 mm typically) to accommodate a two-dimensional dimensional x-y stage 13 with the target plate 11 shown for purposes of illustration on the top. The tip of the extended capillary 18 is located at a distance of 1–2 mm from the target plate 11. One or several sample(s) 12 (liquid droplets of 0.5–5 $\mu$l volume typically) can be put on the target plate at up to 64 spot locations. A voltage of, for example, 0.5–2.5 kV is applied at the connector 14 of the target plate 11 to facilitate migration of ions toward the inlet of the capillary 18. A pressure differential inside the capillary system (between the atmosphere and vacuum housing of a mass spectrometer) conducts ion-containing gasses to flow into the mass analyzer. The mass-analyzer can be any of the mass spectrometers disclosed herein or any other suitable mass spectrometer with atmospheric pressure sampling capability. Such mass analyzers can further include but are not limited ion trap mas spectrometers, quadrupole (Q) mass spectrometers, Q-time-of-flight mass spectrometers, triple quadrupole mass spectrometers, etc.

The plane position of the target plate relative to the extended capillary is controlled by motorized x-y stages connected through a connector 15 and an XY-motor controller (not shown) to a computer (not shown). The ion collection assembly can be located within a housing 10 that may be filled with a dry gas (e.g., nitrogen) to decrease ion losses via ion-molecule reactions. The transfer mechanisms can include the gas flow and electric field assisted transfer devices and mechanisms disclosed herein or other techniques known to those in the art. Such transfer techniques can further include but are not limited to a pin-hole, a diaphragm, a heated capillary, ion mobility transfer techniques, etc.

A laser of the present invention can pulse with a 10–100 ns duration (longer or shorter pulses also can be used) and has sufficient laser fluence to produce ions (e.g., a 150–200 $\mu$J/pulse energy concentrated into an elliptical spot of 130× 220 $\mu$m). The frequency of firing the laser can be, for example, 3–20 Hz. The target plate can be forced to continuously move along a spiral (or any other) line for supplying fresh sample positions for the laser spot. A CCD camera 21 is attached to the AP-LADI housing for monitoring the sample position and the desorption process.

The spectrum of an aqueous solution of three peptides (3 pMol of each: Angiotensin I, FW 1296.5 Da; Bombesin, FW 1619.9 Da; γ-Endorphin, FW 1859.1 Da; all peptides were purchased at Sigma and used without any purification) was recorded using the AP-LADI ion source of the present invention with an IR laser tuned to 3 μm wavelength, interfaced with LCQ ion trap MS (such as for example the MS shown in FIG. 1).

Figure 2A:
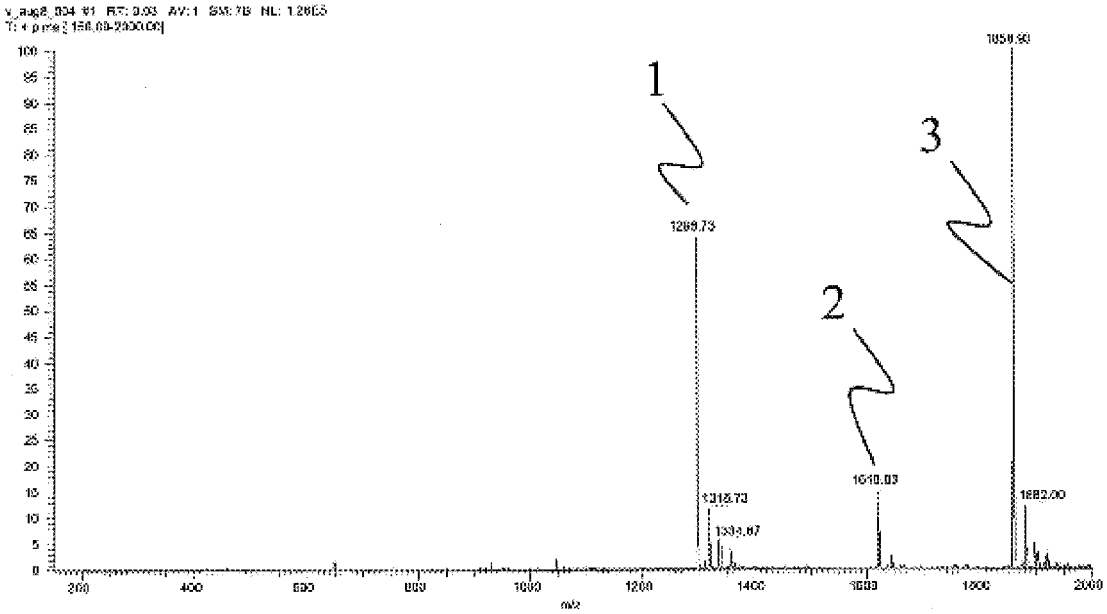
FIGS. 2*a* and 2*b* are representative mass spectra of aqueous solutions of a mixture of three peptides obtained on an AP-LADI-LCQ instrument according to the present invention: A—gold surface, B—steel surface.

In the spectrum shown in FIG. 2*a,* a 0.5 μl droplet of the solution, containing 1.5 pMol of each peptide, was deposited on the steel target plate coated with a gold layer and formed a droplet of approximately 2 mm in diameter and an initial thickness of 0.5–0.7 mm. After deposition of the droplet, the target plate was quickly inserted into the holder of the IR AP/MALDI source interfaced with a Thermo Finnigan LCQ-Classic ion trap mass spectrometer.

Data acquisition was turned on; a target voltage of 2 kV was applied; a 500 msec ion injection time was set; and the Automatic Gain Control was set to OFF. No curtain/auxiliary gas flow was used. Other experiment parameters, typical for an Electrospray mode, are described in the LCQ™ Operator's Manual, Revison B, Finnigan Corp. July 1996, Part #9700–9701, the entire contents of which are incorporated herein by reference. The IR laser irradiated a droplet with laser pulses for 40–60 sec until the whole droplet material was evaporated. The pulse repetition rate was 5 Hz, the wavelength was 3 μm, and the pulse energy was 180–220 μJ. All spectra recorded during this period were accumulated and averaged to produce the spectrum shown in FIG. 2*a*. In FIG. 2*a,* peak 2*a*-1 corresponds to Angiotensin I; peak 2*a*-2—to Bombesin; peak 2*a*-3—to γ-Endorphin. Excellent signal-to-noise ratio for the spectrum in FIG. 2*a* demonstrates the high sensitivity of AP LADI technique of the present invention. There are several satellite peaks to the right of the main molecular $MH^+$ peaks (where M is an analyte molecule; $H^+$ is an attached proton) 2*a*-1, 2*a*-2 and 2*a*-3 (FIG. 2*a*). These weak satellite peaks are typical for both electrospray and MALDI, and correspond to sodium and potassium adduct ions ($MNa^+$ and $MK^-$). The spectrum in FIG. 2*a* demonstrates that the AP LADI spectra obtained with the present invention process under the described conditions have all features of a conventional MALDI spectrum.

However, some observations distinguish the AP LADI method of the present invention from conventional MALDI methods.

First, the MALDI method is based on a phenomenon of matrix material evaporation under the influence of laser pulses. Analyte molecules are embedded into the matrix material (crystals in the case of solid-phase MALDI or liquids for liquid MALDI) and lifted into the gas phase with a stream of the matrix material. A matrix material, such as for example glycerol in liquid MALDI is usually added to obtain spectra at a 3 μm wavelength irradiation. Analyte molecule ionization takes place during the MALDI process by assistance of the matrix material.

If the AP LADI method of the present invention described above was a mere variation of MALDI, then the droplet evaporation time could be estimated based on the energy conservation law. With a laser pulse repetition rate of 5 pulses per second and a measured pulse energy of 300 μJ, then the laser deposits a power of $P=5\times300\times10^{-6}$J/sec$=1.5\times10^{-3}$ W into the liquid droplets.

From thermodynamics, the heat of evaporation of 1 gm of water is 2260 J. Thus, the rate of liquid droplet evaporation by the influence of laser pulses is $R=1.5\times10^{-3}/2260$ gm/sec$=0.66\times10^{-6}$ gm/sec. The time t for the evaporation of a water droplet with a volume of 0.5 μl and the weight of $5\times10^{-3}$ gm can be calculated as $t=0.5\times10^{-3}/0.66\times10^{-6}$ sec or 12.6 min. If there is energy loss or if the laser pulse energy is smaller then 300 J, then the time to evaporation will be even longer. The design of AP LADI source of the present invention enables observation of droplet evaporation by a CCD camera (see FIG. 1).

These observations show that, without the laser irradiation, a 0.5 μl droplet dries in 2–3 min. If the laser is ON, the droplet disappears in a time of 30–50 s much shorter than the calculated time of 12.6. This observation seemingly contradicts the energy conservation law, if the assumption that ordinary droplet surface evaporation takes place is valid.

The absorption of laser pulse in the present invention, owing to the combination of the wavelength of light, the light pulse intensity, and the affected volume of liquid interacting with the laser pulse, likely induces sonic or possibly supersonic waves into the liquid droplet material. These waves induce droplet material splashing which drastically increases the droplet disappearance rate (thus not having to evaporate the entire droplet). The absorption of the laser pulse in the liquid volume of the droplet is such that likely all of the laser energy is absorbed in a thin layer (likely less than several wavelengths of the light) of the liquid adjacent to the surface of the liquid. The expanding liquid in the absorption region generates the aforementioned sonic or possibly supersonic waves.

Second, larger droplets of aqueous analyte solutions give smaller mass spectroscopy signals. For example, if a droplet of 1.5 or 2 μl of the same solution of 3 peptides is deposited on the same target, only a noise signal is recorded for the first several minutes of laser pulse irradiation. Only after the droplet size shrinks by 1.5 to 2 times the original size, does a mass spectrum similar to that in FIG. 2*a* start to accumulate. In general, thinner (i.e. flatter) droplets provide better mass spectroscopy signals.

The dependence of AP LADI ion production on the deposited aqueous droplet size could potentially be related to differences in sonic wave propagation in droplets of different sizes. In smaller droplets, the sonic and/or supersonic waves would likely be concentrated in less volume, splashing of liquid would stronger, and leading one to the observed stronger MS signal. Meanwhile, acoustic liquid oscillations will likely be insignificant in ion production from both conventional vacuum and AP MALDI sources where a plume of hot matrix material is responsible for the subsequent ionization.

Figure 2B:
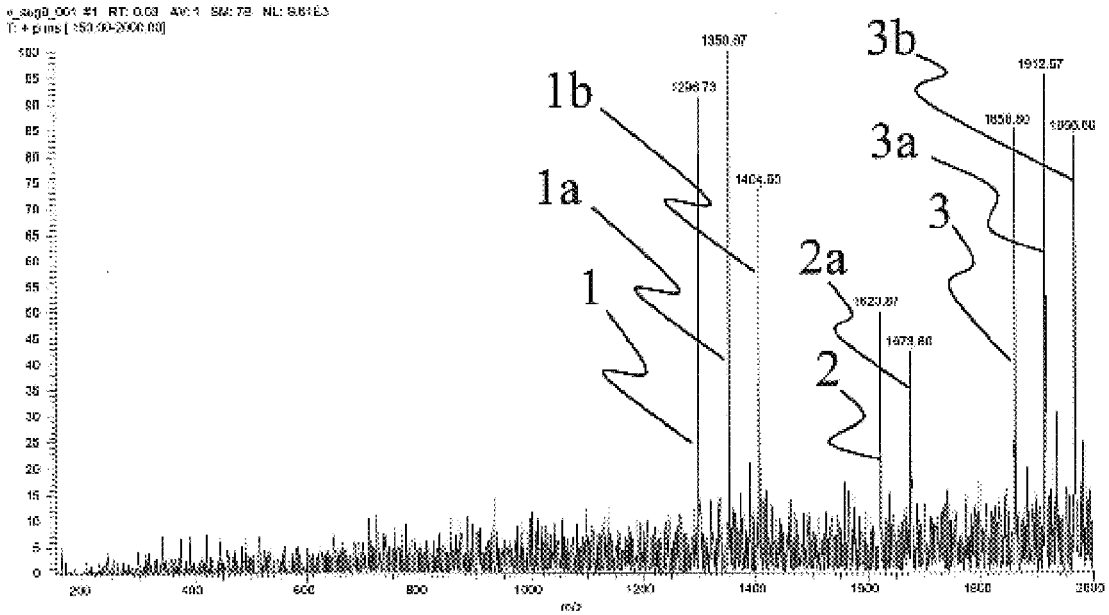

Third, the AP LADI spectra obtained by the present invention depends on the type of target plate surface or substrate on which the analyte solution droplet is deposited. FIG. 2*b* shows an AP LADI spectrum recorded with precisely the same experimental conditions (analyte solution, droplet size, laser energy etc.), but using a steel target plate without a gold coating. The spectrum in FIG. 2*b* is weaker and the signal-to-noise is worse. The same peaks 2*a*-1 (Angiotensin I), 2*a*-2 (Bombesin) and 2*a*-3 (γ-Endorphin) are present in spectra in both FIG. 2*a* and FIG. 2*b*. But, every peak in FIG. 2*b* has very bright satellites with a mass shift of 54 Da (peaks 2*b*-1*a,* 2*b*-2*a* and 2*b*-3*a*) and 108 Da (peaks 2*b*-1*b* and 2*b*-3*b*). The nature of these satellite peaks is unknown yet, but may be attributed to the clusters of three/six water molecules with analyte molecular ions:

$M(H_2O)_3H^+$ and $M(H_2O)_6H^+$. Comparing the spectra of FIG. 2*a* and FIG. 2*b,* the dependence on substrate choice for the AP LADI spectra quality is apparent.

According to the present invention, the AP LADI method can be used for MS analyses of other liquid solutions such as the common analyte solutions previously discussed. The droplet size, laser pulse energy, and target plate material and/or coating are adjusted according to the present invention to optimize ionization efficiency for the type of solvent employed.

The substrate of the present invention is not limited to solids. For example, a porous frit or gel can be used as a support to contain liquid samples. Gels may be used, according to the present invention. Gels play an important role in electrophoretic separation techniques widely used in biochemical and biomedical research. Using two-dimensional gels as a liquid support opens new ways for direct MS analysis of separated biopolymers contained on a gel, a method prior to the present invention which was not possible.

The substrates used in the present invention can include wells or grooves. The wells and grooves can serve to restrict the location of the liquid on the surface of the target plate 11. The liquid solutions can be applied such that a level of the liquid is at the top of the wells or grooves artificially providing a somewhat flatter surface than would normally occur from the expected liquid meniscus. The wells or grooves can serve as array positions for the storage of different liquid solutions, enabling higher throughput for sampling surveys of liquid solutions.

The mass spectrometer interface according to the present invention can be modified so that a continuous flow of a liquid solution (e.g., from a high pressure liquid chromatography HPLC or capillary electrophoresis CE) is supplied directly to the laser spot position. Thus, in one embodiment of the present invention, an effective on-line LC-MS interface can be designed using the AP-LADI ionization method of the present invention. The liquid supply mechanism can include the liquid separation apparatus, the capillary tube, the high performance liquid chromatograph, and the capillary zone electrophoresis unit disclosed herein or other techniques known to those in the art.

Figure 3:
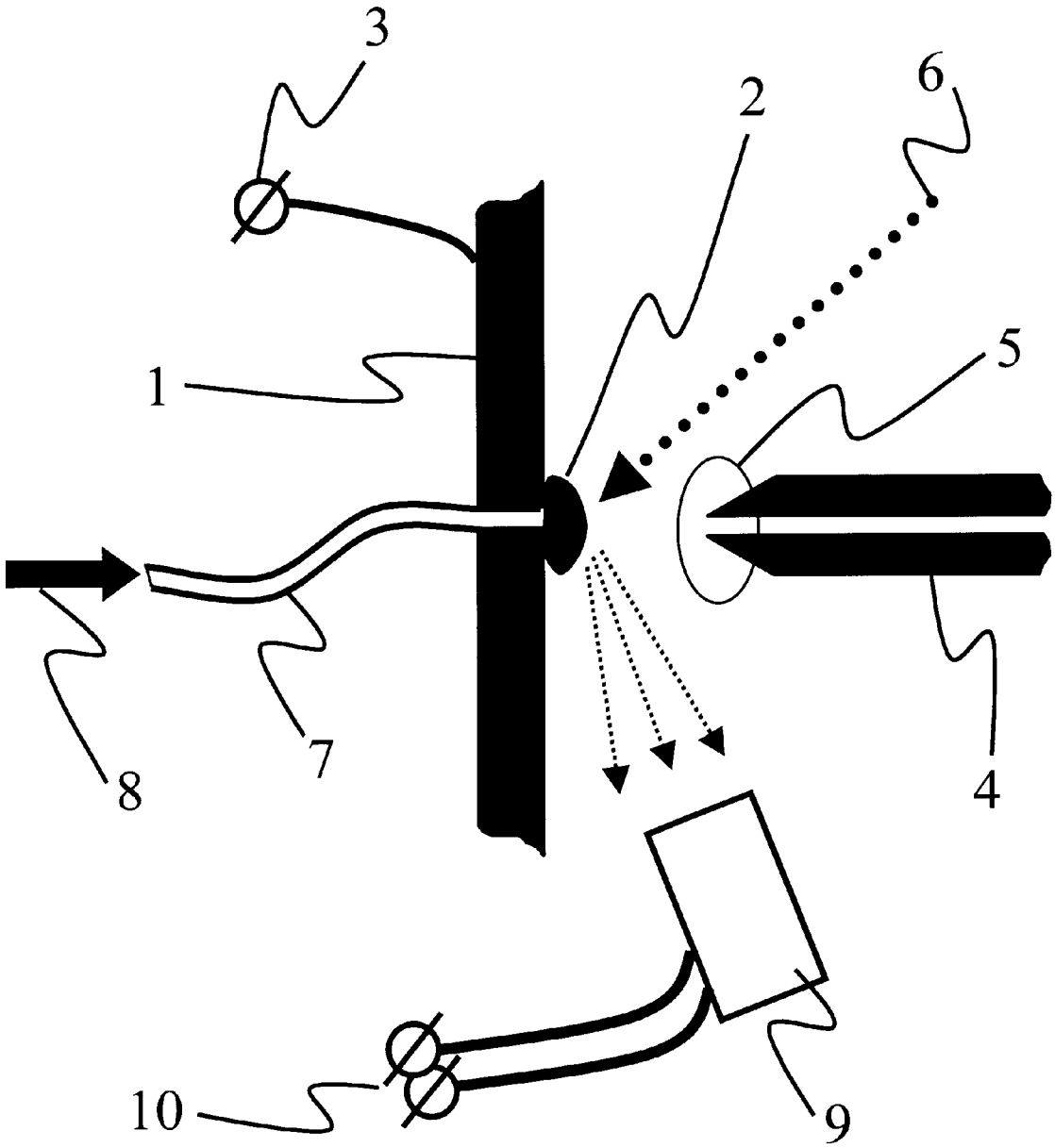
FIG. 3 is a schematic view of a continuous flow AP-LADI source according to the present invention.

A continuous flow AP-LADI source of the present invention is shown schematically in FIG. 3. Details of such a design can be easily described and implemented by those experienced in the art. A liquid solution 38 that is to be mass-analyzed is supplied through a capillary transfer tube 37, connected at one end to a liquid pump such as for example a syringe pump, a liquid chromatography instrument pump, an output of capillary zone electrophoresis installation, or any other device that can provide a liquid analyte solution flow. The other end of the transfer tube 37 is inserted in the target plate 31 so that a liquid droplet 32 of the analyte solution is formed at the surface of the plate.

Either the bulk material and/or the coating of the plate 31 is chosen to achieve adequate ion production. In one embodiment of the present invention, the following two-layer coating of a target steel plate is used with a 10–15 $\mu$m of nickel as a first layer on the steel plate and a 10–15 $\mu$m of gold as a second layer above the first layer. The droplet 32 is irradiated with laser pulses 36 so that the LADI process of the present invention takes place. Ions produced by LADI are conducted through an orifice 35 into an inlet of the MS instrument either directly or indirectly (see i.e. with or without a capillary extender 34).

High voltage is applied to plate 31 through a connector 33, assisting the ion transfer toward the orifice 35. The AP-LADI source may be equipped with a detector 39 sensitive to the size of a droplet 32. For example, scattered laser radiation can be detected with a photosensor 39 and utilized to determine droplet size. The signal from the photosensor existing on signal line 40 can be used to maintain a balance between the liquid consumption by the LADI process and the liquid delivery through the capillary 37.

One or more of the following parameters may be regulated to achieve the balance: liquid flow rate, laser pulse energy, laser pulse repetition rate. It is preferred to maintain a definite droplet size for stable source operation in the present invention, because the AP-LADI ion production efficiency has been shown by way of the present invention to be dependent on droplet shape and thickness. Additionally, the continuous flow AP-LADI source of the present invention may incorporate various parts similar to that of the AP-LADI source in FIG. 1 (a CCD observation camera, source housing and so on) which are not shown in the schematic view in FIG. 3.

Figure 4:
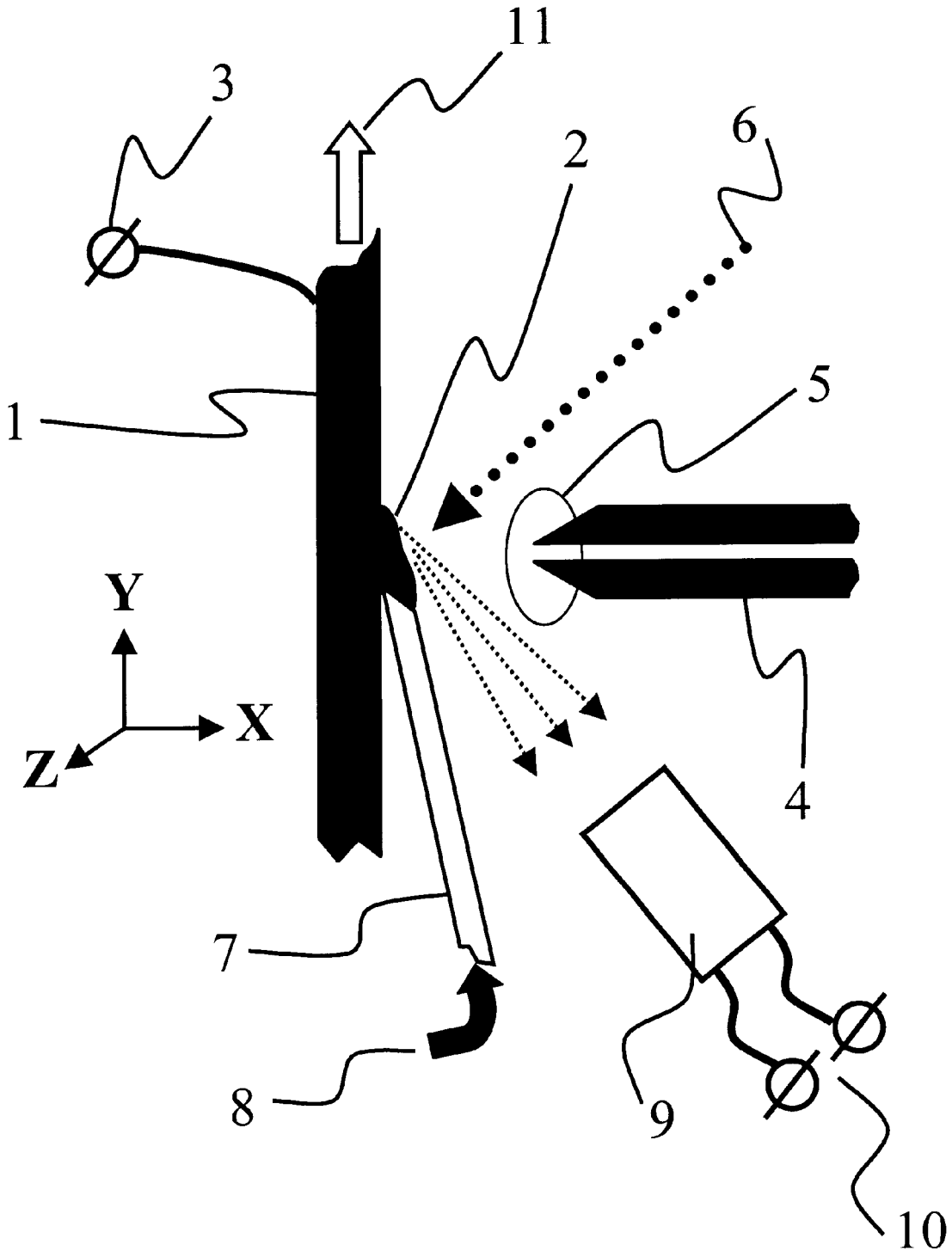
FIG. 4 is a schematic view of another embodiment of a continuous flow AP-LADI source according to the present invention.

Another embodiment of continuous flow AP LADI source is represented schematically in FIG. 4. The design is similar to that in FIG. 3: a liquid solution 38 is supplied through a capillary tube 37 toward the surface of the target plate 31. The outlet end of the capillary 37 is either separated by a very short distance from the surface of the target plate 31, or can gently touch the surface. Again, the voltage is applied to the target plate 31 through the connector 33. The liquid solution droplet 32 is irradiated with laser pulses 36 so that the LADI process takes place. Ions produced by LADI are conducted through the orifice 35 into an inlet of the MS instrument either directly or indirectly through a capillary extender 34. The AP-LADI source of the present invention may be equipped with a detector 39 sensitive to the size of a droplet 32. The signal of the photosensor can be used to balance the liquid consumption by the LADI process with the liquid delivery through the capillary 37.

An advantage of the AP-LADI source design, schematically represented in the FIG. 4, is the potential movement of the target plate 31 in a relative direction 41 to the capillary 37 and inlet orifice 35. As a result, the thickness of the droplet 32 may be essentially decreased, and thin layer AP LADI is possible.

Figure 5:
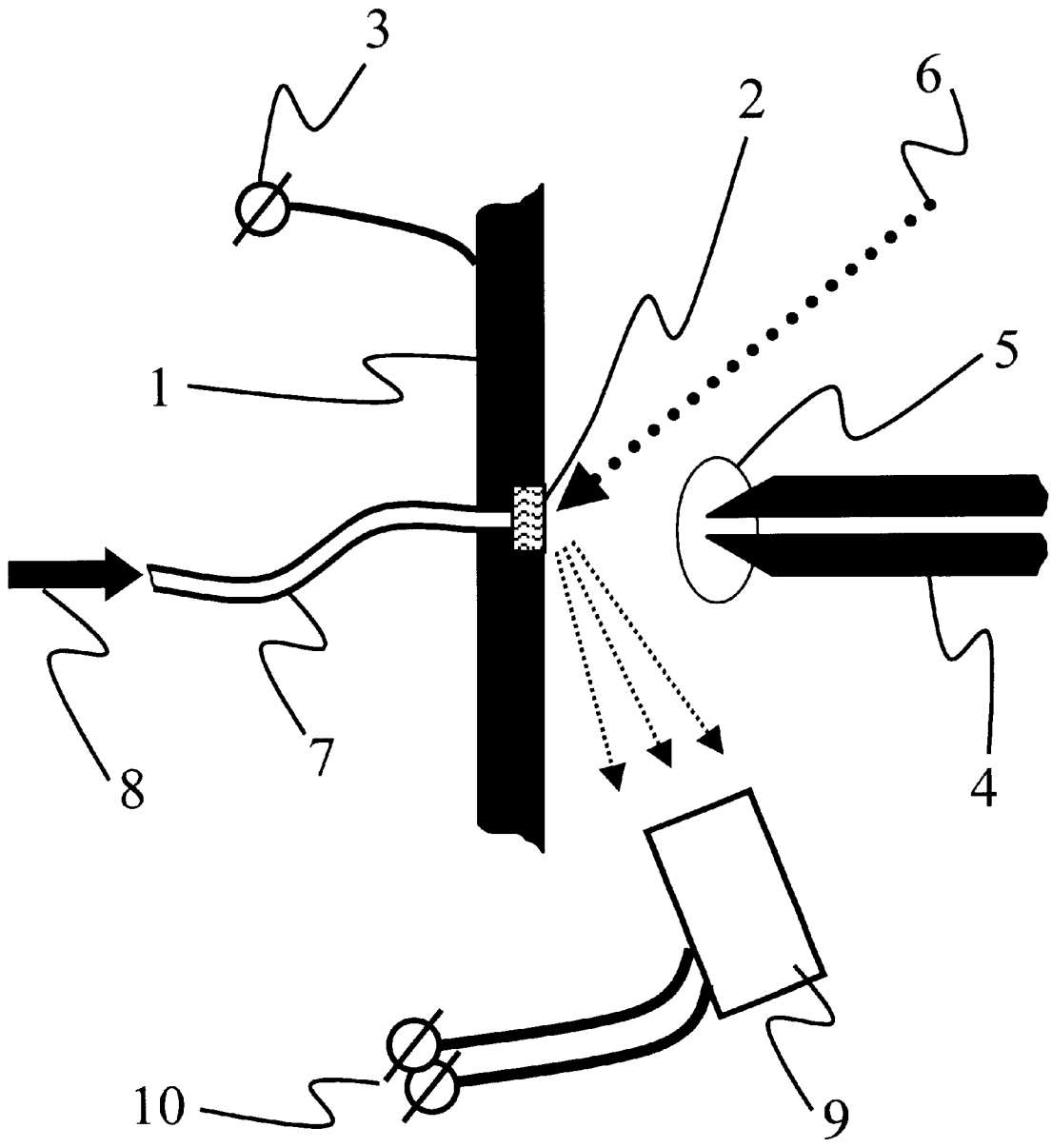
FIG. 5 is a schematic view of another embodiment for a continuous flow AP-LADI source according to the present invention.

Since the ion production with AP-LADI from small and flat droplets is enhanced, surface motion of the target plate 31 yields smaller flatter droplet traces on the target surface. Thus, the plate, according to the present invention, can be made as a disk rotating around the X axis (as shown in FIG. 4), or a large cylinder rotating around the Y axes, or can be made of a flexible film propagating in the Y direction similar to a cassette on a tape recorder. In any case, the target surface is optimized for the maximum ion production. In another embodiment shown in FIG. 5, a frit 42 is used on the exit of capillary to better assist interaction of the infrared irradiation with the liquid. The effluent coming from the frit surface is irradiated by IR laser to produce the ions. Other features of this method are similar to that shown in FIG. 3.

Figure 6:
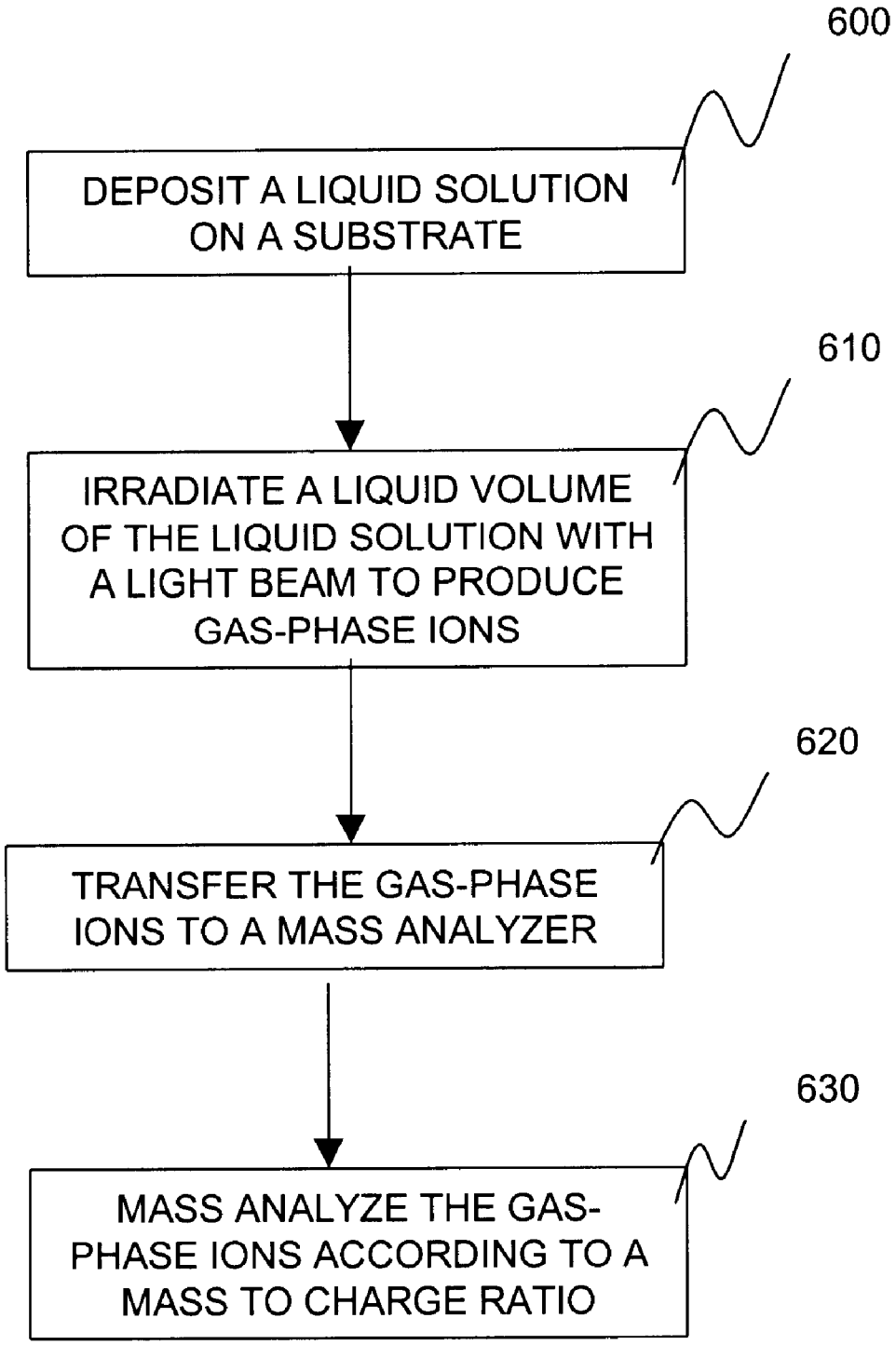
FIG. 6 is a flowchart depicting a method of the present invention.

FIG. 6 is a flowchart depicting a method of the present invention. As shown in FIG. 6, in step 610, a liquid solution on a target is irradiated with a light beam to produce gas-phase ions. In step 620, the gas-phase ions are transferred to a mass analyzer. In step, 630, the gas-phase ions, having been transferred to the mass spectrometer, are mass analyzed according to a mass to charge ratio.

Step 600 of the present invention can include the steps of depositing the liquid solution on a substrate. The substrate can be either electrically conducting or non-conducting. The liquid solution can be deposited on a gold surface, a stainless steel surface, or a frit. The substrate material can be curved, can include a well, or can include a groove. Placing the liquid solution in a well or a groove makes the irradiated surface flatter (potentially, the liquid can be flush with the top of the wells or grooves). Second, placement in the wells or grooves serves to confine the liquid solution, preventing the liquid from arbitrarily spreading about a surface of the substrate. The liquid solution can be deposited on a gel, and the gel can be formed by a biopolymer separation using a 2D gel electrophoresis method. The liquid solution can be deposit multiple liquid solutions on an array of positions on the substrate to facilitate high throughput analysis.

Step 600 of the present invention can include the step of delivering laser pulses to the surface of the liquid solution using an optical fiber, can include irradiating a volume of the liquid solution with the liquid solution including a solvent having at least one of water, organic fluid, inorganic fluid, and a mixture thereof, can irradiate the liquid solution with a laser wavelength which is absorbed by the liquid solution, and can irradiate a hydrous solution with infrared laser pulses at a wavelength close to 3 $\mu$m.

Step 600 of the present invention can provide a continuous flow of the liquid solution through a capillary transfer tube to compensate for liquid solution losses due to light irradiation and evaporation, can move the substrate with respect to the capillary transfer line, can move the substrate with respect to an inlet of the mass analyzer, and can supply the liquid solution to target to maintain a deposit of a thin liquid layer to thereby increase ionization efficiency.

Further, step 600 of the present invention can utilize a frit at an exit end of the capillary transfer line to interface a continuous flow of the liquid solution with laser pulses from the laser, can utilize a sensor to sense a balance of the liquid solution and thereby can regulate the balance by providing an adjustment to at least one of the liquid flow rate, laser pulse energy, and repetition rate. Step 600 of the present invention can utilize a liquid separation apparatus, such as for example a high-performance liquid chromatograph and a capillary zone electrophoresis unit, to provide the continuous flow of the liquid, can provide a mechanism configured to on-line couple the liquid separation apparatus to the mass spectrometer, and can utilize a flow splitter to direct a part of an effluent solution from the liquid separation apparatus into the mass spectrometer.

Step 620, according to the present invention, can place the liquid solution close to the inlet port or an attached inlet orifice of the mass spectrometer, can generate an electric field between the liquid solution and the inlet port or an attached inlet orifice of the mass spectrometer to assist in transfer of the gas-phase ions, can utilize at least one gas nozzle to produce a gas flow to transfer the gas-phase ions toward the inlet port or the attached inlet orifice of the mass spectrometer, and can transfer the gas-phase ions in a housing filled with a gas under defined pressure and temperature conditions.

Step 620, according to the present invention, can mass-analyze solutions of organic and inorganic compounds including peptides, proteins, nucleic acids, polymers, drugs and other compounds of biological, medical, or industrial significance.

Additional modifications and variations of the present invention are possible in light of the above teachings. It is therefore to be understood that within the scope of the appended claims, the invention may be practiced otherwise than as specifically described herein.

What is claimed is:

1. A method for mass spectroscopic analysis of an analyte solution, comprising:

irradiating a liquid volume of said analyte solution without an added matrix with a light beam to desorb solution-specific ions into a surrounding gas to produce gas-phase ions;

transferring said gas-phase ions to a mass analyzer; and mass-analyzing said gas-phase ions by said mass analyzer.

2. The method as in claim 1, wherein the step of irradiating with a light beam comprises:

irradiating with a laser beam.

3. The method as in claim 2, wherein the step of irradiating with a laser beam comprises:

pulsing with a laser beam.

4. The method as in claim 3, wherein the step of irradiating comprises:

producing said gas-phase ions at or about atmospheric pressures.

5. The method as in claim 1, wherein the step of transferring comprises:

transferring said gas-phase ions to an inlet port of a mass spectrometer equipped with an atmospheric pressure interface.

6. The method as in claim 1, further comprising:

depositing said analyte solution on a substrate, prior to the step of irradiating, to produce at least one of a droplet and a thin liquid layer.

7. The method as in claim 6, wherein the step of depositing comprises:

depositing a matrix-free analyte solution.

8. The method as in claim 6, wherein the step of depositing comprises:

producing said droplet with said liquid volume less than 2 $\mu$l.

9. The method as in claim 6, wherein said step of depositing comprises:

depositing said analyte solution on at least one of a gold surface, a stainless steel surface, a substrate including at least one well, and a substrate including at least one groove.

10. The method as in claim 6, wherein said step of depositing comprises:

depositing said analyte solution on at least one of a frit and a gel.

11. The method as in claim 10, wherein said gel is formed by a biopolymer separation using a two-dimensional gel electrophoresis method.

12. The method as in claim 6, wherein said step of depositing comprises:

depositing said analyte solution on a surface of the substrate, said surface configured to flatten an exposed surface of said analyte solution.

13. The method as in claim 12, wherein said step of depositing said analyte solution on a surface comprises:

depositing said analyte solution on a curved exposed surface.

14. The method as in claim 6, wherein said step of depositing comprises:

depositing samples of multiple analyte solutions on an array of positions on the substrate.

15. The method as in claim 1, wherein said step of transferring comprises:

placing said analyte solution close to at least one of an inlet port of said mass analyzer and an inlet orifice attached to said inlet port.

16. The method as in claim 1, wherein said step of transferring comprises:

generating an electric field between said analyte solution and at least one of an inlet port of said mass analyzer and an inlet orifice attached to said inlet port to assist in transfer of said gas-phase ions into the mass analyzer.

17. The method as in claim 1, wherein said step of transferring comprises:

producing a gas flow with at least one gas nozzle, said gas flow being configured to transfer said gas-phase ions toward at least one of an inlet port of said mass analyzer and an inlet orifice attached to said inlet port.

18. The method as in claim 1, wherein said step of irradiating comprises:

irradiating a liquid solution including at least one of water, organic fluid, inorganic fluid, and a mixture thereof.

19. The method as in claim 1, wherein said step of mass-analyzing comprises:

analyzing liquid solutions of organic and inorganic compounds including peptides, proteins, nucleic acids, polymers, drugs and other compounds of biological, medical, or industrial significance.

20. The method as in claim 1, wherein said step of irradiating comprises:

irradiating said analyte solution at a wavelength which is absorbed by said analyte solution within a few wavelengths of the light beam.

21. The method as in claim 1, wherein said step of irradiating comprises:

irradiating an hydrous solution with infrared laser pulses at a wavelength close to 3 $\mu$m.

22. The method as in claim 6, further comprising:

providing a liquid flow of said analyte solution to said substrate through a capillary transfer line to compensate for analyte solution losses due to laser pulse irradiation and evaporation.

23. The method as in claim 22, wherein said step of providing comprises:

moving said substrate with respect to the capillary transfer line; and supplying the liquid flow of said analyte solution to the substrate to maintain a deposit of a thin liquid layer to thereby increase ionization efficiency.

24. The method as in claim 22, wherein said step of providing comprises:

moving said substrate with respect to an inlet port of said mass analyzer; and supplying the liquid flow of said analyte solution to the substrate to maintain a deposit of a thin liquid layer to thereby increase ionization efficiency.

25. The method as in claim 22, wherein said step of providing comprises:

sensing a balance of said analyte solution; and regulating the balance by adjusting at least one of said liquid flow, a laser pulse energy, and a laser repetition rate.

26. The method as in claim 25, wherein said step of providing comprises:

providing a continuous flow of the analyte solution.

27. The method as in claim 25, wherein said step of providing comprises:

on-line coupling of said liquid flow to the mass analyzer.

28. A system for the mass spectroscopic analysis of an analyte solution, comprising:

means for irradiating a liquid volume of said analyte solution without an added matrix to desorb solution-specific ions into a surrounding gas to produce gas-phase ions;

means for mass-analyzing said gas-phase ions; and means for transferring said gas-phase ions into said means for mass-analyzing.

29. The system as in claim 28, further comprising:

means for depositing said analyte solution on a surface of a substrate.

30. The system as in claim 29, wherein said means for depositing is configured to deposit a matirx-free analyte solution.

31. The system as in claim 29, wherein said substrate comprises:

at least one of a substrate including at least one of a gold surface, a stainless steel surface, at least one well, and at least one groove.

32. The system as in claim 29, wherein said substrate comprises:

at least one of a frit and a gel.

33. The system as in claim 29, wherein means for depositing comprises:

means for forming at least one of a droplet and a thin layer of said analyte solution.

34. The system as in claim 33, wherein said droplet comprises a droplet with said liquid volume less than 2 $\mu$l.

35. The system as in claim 29, wherein said substrate comprises:

an array with positions on the array configured to deposit samples of multiple analyte solutions.

36. The system as in claim 29, wherein said means for depositing comprises:

means for flattening an exposed surface of said analyte solution.

37. The system as in claim 28, wherein said means for irradiating comprises:

an optical fiber configured to deliver light from said means for irradiating said liquid volume of said analyte solution.

38. The system as in claim 28, wherein said means for transferring comprises:

an electric field between said analyte solution and an inlet of said means for mass analyzing to assist in transfer of said gas-phase ions into the means for mass analyzing.

39. The system as in claim 28, wherein said means for transferring comprises:

at least one gas nozzle configured to produce a gas flow to transfer said gas-phase ions toward an inlet of said means for mass analyzing.

40. The system as in claim 28, wherein said means for irradiating a surface comprises:

means for irradiating at a wavelength which is absorbed by said analyte solution within a few wavelengths of light from said means for irradiating.

41. The system as in claim 28, wherein said means for irradiating comprises:

means for pulsing an infrared laser light at a wavelength of about 3 $\mu$m.

42. The system as in claim 29, further comprising:

means for providing a liquid flow of said analyte solution to said substrate to compensate for analyte solution losses due to irradiation and evaporation.

43. The system as in claim 42, wherein said means for providing comprises:

means for moving said substrate relative to said means for providing; and means for supplying said liquid flow to the substrate to maintain a deposit of a thin liquid layer.

44. The system as in claim 42, wherein said means of providing comprises:

means for moving said substrate relative to said means for mass analyzing; and means for supplying the liquid flow of said analyte solution to the substrate to maintain a deposit of a thin liquid layer to thereby increase ionization efficiency.

45. The system as in claim 42, wherein said means for providing comprises:

means for sensing a balance of said analyte solution; and means for regulating said balance by adjusting to at least one of said liquid flow, a laser pulse energy, and a laser repetition rate.

46. The system as in claim 42, wherein said means for providing comprises:

means for providing a continuous flow of the analyte solution.

47. The system as in claim 42, wherein said means for providing comprises:

means for on-line coupling of said means for providing to said means for mass analyzing.

48. The system as in claim 42, wherein said means for providing comprises:

means for directing a part of an effluent solution from said means for providing into said means for mass analyzing.

49. The system as in claim 28, wherein said means for transferring comprises:

a housing filled with a gas under defined pressure and temperature conditions.

50. An apparatus for the mass spectroscopic analysis of an analyte solution, comprising:

a light source configured to irradiate a liquid volume of said analyte solution without an added matrix to desorb solution-specific ions into a surrounding gas to produce gas-phase ions;

a mass analyzer configured to mass-analyze said gas-phase ions; and a transfer mechanism configured to transfer said gas-phase ions to said mass analyzer.

51. The apparatus as in claim 50, wherein the light source comprises a laser beam.

52. The apparatus as in claim 51, wherein the laser beam is configured to generate a pulsed laser beam.

53. The apparatus as in claim 50, wherein said gas-phase ions are produced at or about atmospheric pressures.

54. The apparatus as in claim 50, wherein the transfer mechanism includes an inlet port on a mass spectrometer equipped with an atmospheric pressure interface.

55. The apparatus as in claim 50, further comprising:

a substrate configured to receive said analyte solution.

56. The apparatus as in claim 55, wherein said substrate comprises:

at least one of a gold surface, a stainless steel surface, at least one well, and at least one groove.

57. The apparatus as in claim 56, wherein said substrate comprises:

a 10–15 $\mu$m nickel layer; and a 10–15 $\mu$m gold layer on top said nickel layer.

58. The apparatus as in claim 55, wherein said substrate includes at least one of a frit and a gel.

59. The apparatus as in claim 58, wherein said gel comprises:

a gel formed by a biopolymer separation using a two-dimensional gel electrophoresis method.

60. The apparatus as in claim 55, wherein said substrate comprises:

a surface configured to flatten a surface of said analyte solution.

61. The apparatus as in claim 60, wherein said surface comprises:

a curved exposed surface.

62. The apparatus as in claim 55, wherein said substrate comprises:

an array with positions on the array configured to deposit multiple analyte solutions.

63. The apparatus as in claim 50, further comprising:

an optical fiber configured to deliver laser pulses to said analyte solution.

64. The apparatus as in claim 50, wherein said mass analyzer comprises:

at least one of an inlet orifice attached to an inlet port of a mass spectrometer and a capillary tube attached to said inlet port.

65. The apparatus as in claim 50, wherein the transfer mechanism comprises:

an electric field between said analyte solution and at least one of an inlet port and a capillary tube attached to said inlet port.

66. The apparatus as in claim 50, further comprising:

at least one gas nozzle configured to transfer said gas-phase ions toward at least of an inlet orifice attached to an inlet port of a mass spectrometer and a capillary tube attached to said inlet port.

67. The apparatus as in claim 50, wherein the analyte solution comprises:

a liquid solution including at least one of water, organic fluids, inorganic fluids, and a mixture thereof.

68. The apparatus as in claim 50, wherein the analyte solution comprises:

a liquid solution including at least one of peptides, proteins, nucleic acids, polymers, drugs, and other compounds of biological, medical, or industrial significance.

69. The apparatus as in claim 50, wherein said light source is configured to irradiate said analyte solution with laser pulses at a wavelength which is absorbed by the analyte solution within a few wavelengths of light from the light source.

70. The apparatus as in claim 50, wherein said light source is configured to irradiate said analyte solution at a wavelength which is absorbed by the analyte solution within a few wavelengths of light from the light source.

71. The apparatus as in claim 50, wherein the analyte solution comprises a hydrous solution and the hydrous solution is irradiated by infrared laser pulses at a wavelength close to 3 $\mu$m.

72. The apparatus as in claim 55, further comprising:

a supply mechanism configured to supply the analyte solution to said substrate.

73. The apparatus as in claim 72, wherein the supply mechanism comprises:

a capillary transfer line.

74. The apparatus as in claim 73, further comprising:

a motion mechanism configured to move said substrate with respect to the capillary transfer line; and a supply mechanism configured to supply the analyte solution to the substrate to maintain a thin liquid layer to thereby increase ionization efficiency.

75. An apparatus as in claim 74, wherein the supply mechanism includes a frit at an exit end of said supply mechanism to interface the liquid flow of the analyte solution with light from said light source.

76. The apparatus as in claim 55, further comprising:

a motion mechanism configured to move said substrate with respect to an inlet port of said mass analyzer; and a supply mechanism configured to supply a liquid flow of the analyte solution to the substrate to maintain a thin liquid layer to thereby increase ionization efficiency.

77. An apparatus as in claim 76, wherein the supply mechanism includes a frit at an exit end of said supply mechanism to interface the liquid flow of the analyte solution with light from said light source.

78. The apparatus as in claim 50, further comprising:

a sensor configured to regulate a balance of said volume of said analyte solution; and a mechanism to regulate the balance by adjusting at least one of a liquid flow rate, a light beam pulse energy, and a pulse repetition rate.

79. The apparatus as in claim 78, further comprising:

a liquid separation apparatus configured to provide a continuous flow of the analyte solution to the mass analyzer to thereby provide on-line coupling to said mass analyzer.

80. The apparatus as in claim 79, wherein the liquid separation apparatus includes at least one of a high-performance liquid chromatograph and a capillary zone electrophoresis unit.

81. The apparatus as in claim 79, further comprising:

a flow splitter configured to direct a part of an effluent solution from said liquid separation apparatus into said mass analyzer.

82. The apparatus as in claim 50, further comprising:

a housing filled with a gas under defined pressure and temperature conditions.

83. The apparatus as in claim 50, wherein said liquid volume comprises:

a volume of a droplet less than 2 $\mu$l.

84. The apparatus as in claim 50, wherein said liquid volume comprises:

a volume of a thin liquid layer atop a substrate.

85. The apparatus as in claim 50, wherein said analyte solution comprises:

a matrix-free analyte solution.

* * * * *